US007198157B2

(12) United States Patent
King et al.

(10) Patent No.: US 7,198,157 B2
(45) Date of Patent: Apr. 3, 2007

(54) METHOD AND APPARATUS FOR CLASSIFYING CURRENCY ARTICLES

(75) Inventors: Katharine Louise King, Hampshire (GB); Jack Sharman, Berkshire (GB)

(73) Assignee: MEI, Inc., West Chester, PA (US)

( * ) Notice: Subject to any disclaimer, the term of this patent is extended or adjusted under 35 U.S.C. 154(b) by 0 days.

(21) Appl. No.: 10/326,248

(22) Filed: Dec. 20, 2002

(65) Prior Publication Data

US 2003/0136629 A1 Jul. 24, 2003

(30) Foreign Application Priority Data

Dec. 28, 2001 (EP) ..... 01310949

(51) Int. Cl.
*G07D 7/00* (2006.01)

(52) U.S. Cl. ..... 209/552; 194/302

(58) Field of Classification Search ..... 209/534, 209/552, 56, 556; 194/206, 207, 303, 318, 194/328, 330, 334, 335, 302
See application file for complete search history.

(56) References Cited

U.S. PATENT DOCUMENTS 5,351,798 A * 10/1994 Hayes ..... 194/318
5,392,364 A * 2/1995 Yokoyama et al. ..... 382/190
5,404,987 A * 4/1995 Allan et al. ..... 194/317
5,522,491 A * 6/1996 Baudat et al. ..... 194/207
5,931,277 A 8/1999 Allan et al.
6,092,059 A 7/2000 Straforini et al.
2004/0050652 A1* 3/2004 Voser ..... 194/302

FOREIGN PATENT DOCUMENTS

| | | | |
|---|---|---|---|
| EP | 0 779 604 A1 | | 6/1997 |
| GB | 2 238 152 A | | 1/1991 |
| GB | 2 250 848 A | | 6/1992 |
| GB | 2 251 111 A | | 6/1992 |
| GB | 2300746 A | * | 11/1996 |
| WO | WO 91/06074 | | 5/1991 |
| WO | WO 92/18951 | | 10/1992 |
| WO | WO 96/36022 | | 11/1996 |

* cited by examiner

*Primary Examiner*—Joseph C. Rodriguez
(74) *Attorney, Agent, or Firm*—Fish & Richardson P.C.

(57) ABSTRACT

Articles of currency, for example coins, are validated by progressively eliminating candidate target classes in successive classification stages. A Mahalanobis distance associated with a plurality of properties is calculated over successive stages, the results at each stage being used to reduce the number of target classes, and hence the number of calculations required, in the successive stage or stages. Preliminary stages may represent Mahalanobis distance calculations for a sub-set of the measurements represented by the final Mahalanobis distance calculation. Thus, the Mahalanobis distance calculation can be started before some of the measurement parameters required for the later stages are available.

12 Claims, 3 Drawing Sheets

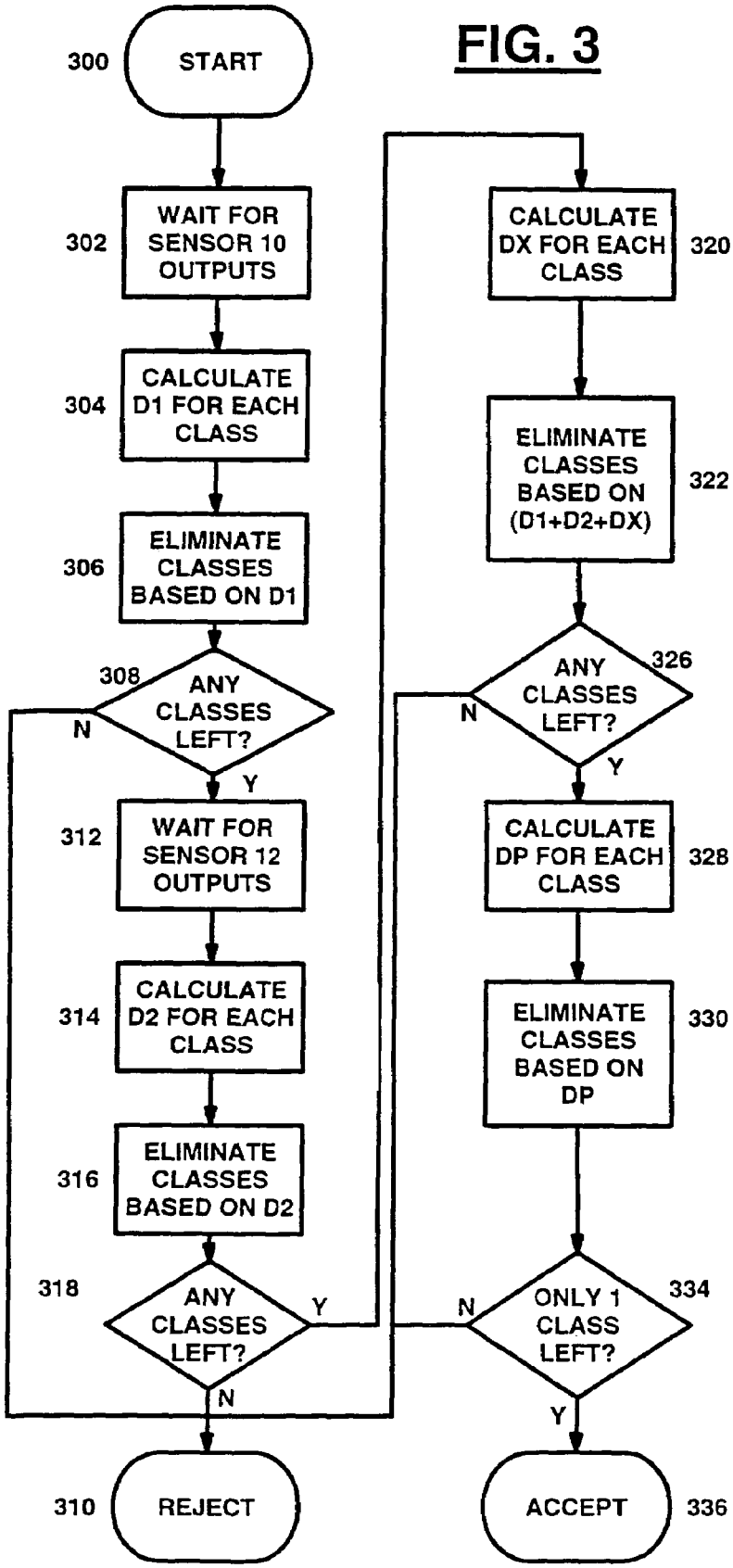
FIG. 3
300
START
302
WAIT FOR SENSOR 10 OUTPUTS
304
CALCULATE D1 FOR EACH CLASS
306
ELIMINATE CLASSES BASED ON D1
308
ANY CLASSES LEFT?
N
Y
312
WAIT FOR SENSOR 12 OUTPUTS
314
CALCULATE D2 FOR EACH CLASS
316
ELIMINATE CLASSES BASED ON D2
318
ANY CLASSES LEFT?
Y
N
310
REJECT
320
CALCULATE DX FOR EACH CLASS
322
ELIMINATE CLASSES BASED ON (D1+D2+DX)
326
ANY CLASSES LEFT?
N
Y
328
CALCULATE DP FOR EACH CLASS
330
ELIMINATE CLASSES BASED ON DP
334
ONLY 1 CLASS LEFT?
N
Y
336
ACCEPT

METHOD AND APPARATUS FOR CLASSIFYING CURRENCY ARTICLES

This invention relates to methods and apparatus for classifying articles of currency. The invention will be primarily described in the context of validating coins but is applicable also in other areas, such as banknote validation.

Various techniques exist for determining whether a currency article such as a coin is genuine, and if so its denomination. Generally speaking, these techniques involve taking a number of measurements of the article, and determining whether all the measurements fall within ranges which would be expected if the article belongs to a particular target denomination, or target class. One common technique involves "windows" or target ranges each associated with a particular measurement. If all the measurements fall within the respective windows associated with a particular denomination, then the article is classed as having that denomination.

It has been recognised that this can produce problems in that it can result either in a non-genuine article being incorrectly judged as being genuine and belonging to one particular denomination, or, depending upon the sizes of the windows, a genuine article could be mis-classified as a non-genuine article.

In the past, there have been disclosed a number of techniques for dealing with this problem by taking into account not only the expected values of the respective measurements for a particular target class, but also the expected correlation between those measurements. Examples of prior art which relies upon such correlations are disclosed in WO-A-91/06074 and WO-A-92/18951.

One technique which can be used for judging the authenticity of a currency article involves calculating a Mahalanobis distance. According to this technique, each target class is associated with a stored set of data which, in effect, forms an inverse co-variance matrix. The data represents the correlation between the different measurements of the article. Assuming that n measurements are made, then the n resultant values are combined with the n×n inverse co-variance matrix to derive a Mahalanobis distance measurement D which represents the similarity between the measured article and the mean of a population of such articles used to derive the data set. By comparing D with a threshold, it is possible to determine the likelihood of the article belonging to the target denomination.

This provides a very effective way of authenticating and denominating coins. GB-A-2250848 discloses a technique for validating based on calculation of Mahalanobis distances. WO 96/36022 discloses the use of Mahalanobis distances for checking authenticity so that adjustment of acceptance parameters will take place only if an accepted currency article is highly likely to have been validated correctly.

Although calculating Mahalanobis distances is very effective, it involves many calculations and therefore requires a fast processor and/or takes a large amount of time. It is to be noted that a separate data set, and hence a separate Mahalanobis distance calculation, is required for each target denomination. Furthermore, the time available for authenticating a coin is often very short, because the coin is moving towards an accept/reject gate and therefore the decision must be made and if appropriate the gate operated before the coin reaches the gate.

It would be desirable at least to mitigate these problems.

Aspects of the present invention are set out in the accompanying claims.

In accordance with a further aspect of the invention, in order to determine whether a measured article belongs to one of a number of different target classes on the basis of a plurality of measurements, several stages of classification are used, together with data derived from an analysis of correlations between those measurements for different target classes to determine whether the tested article is likely to belong to any one of those target classes. A first stage uses a first subset of the measurements and a subset of the data. A second classification stage carries out a similar operation, using different subsets of data and measurements. A third classification stage uses a further measurement subset, which may include measurements which were used in different earlier stages, and a further subset of data. Thus, a complete set of classification stages examines the relationships between multiple properties to determine whether they correspond to the correlations expected of different target classes, but this determination is split into several successive stages. Each stage uses only some of the measurements together with part of the data representing correlations between the full set of measurements. Although the data part may not be an accurate representation of the expected correlation between the measurements of the subset (because it is taken from data representing correlation involving additional measurements), nevertheless it can be used to provide effective discrimination. This can have a number of advantages.

By using this technique it is possible to carry out a preliminary test, the results of which will be dependent on the relationship between different measurements, and which can therefore be used to eliminate target denominations if the results show that the article does not belong to these target denominations. This means that succeeding stages in the calculation are carried out in respect of only some of the target classes, thus reducing the overall number of required calculations.

Alternatively, or additionally, the earlier stages of the calculations can be carried out before the derivation of the measurements which are needed for the later stages of the calculation. In this way, a greater overall amount of time is provided for the processing of the measurements.

An embodiment of the present invention will now be described by way of example with reference to the accompanying drawings, in which:

FIG. 3 is a flow chart showing an acceptance-determining operation of the validator.

Figure 1:
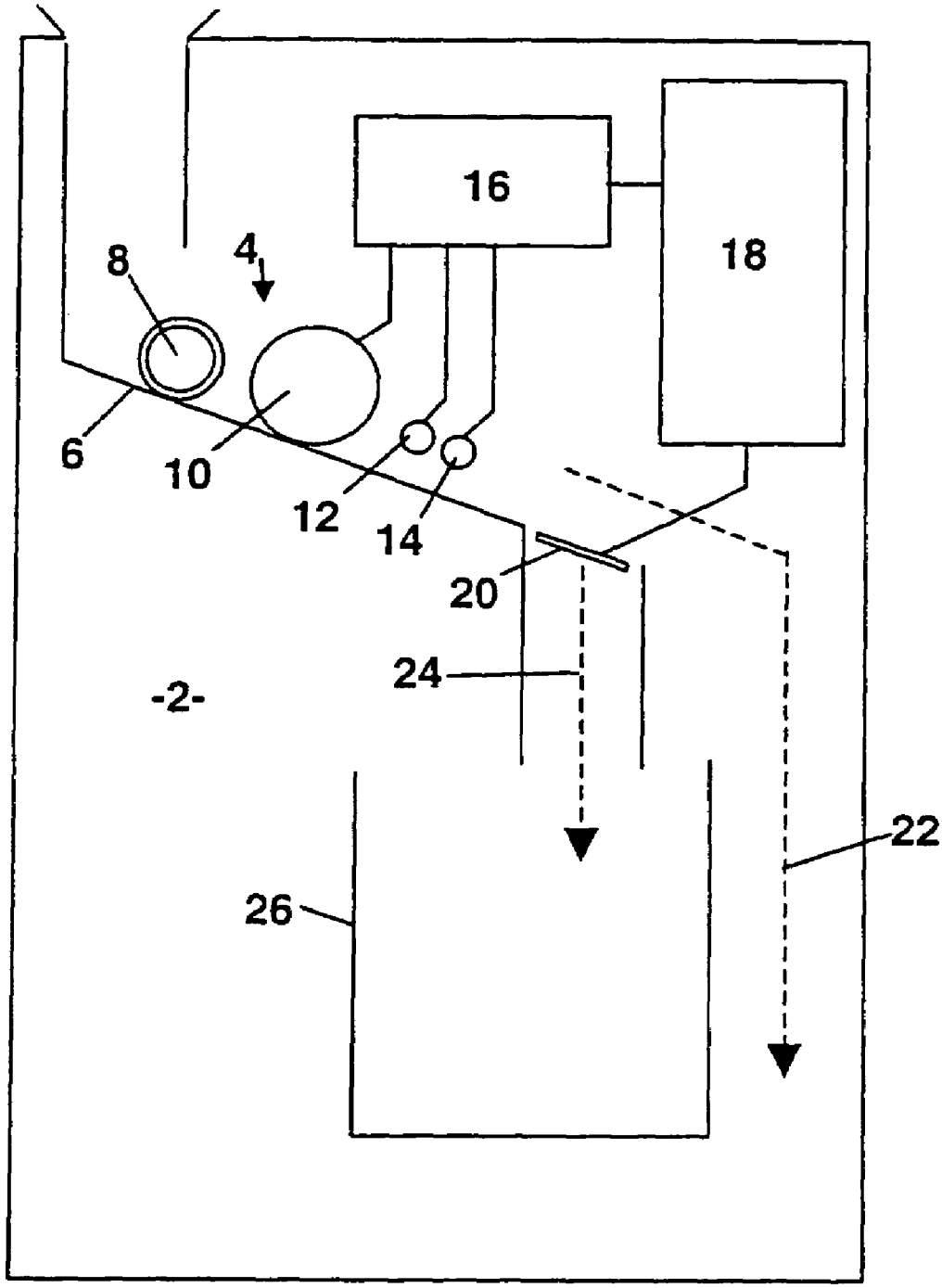
FIG. 1 is a schematic diagram of a coin validator in accordance with the invention.

Referring to FIG. 1, a coin validator 2 includes a test section 4 which incorporates a ramp 6 down which coins, such as that shown at 8, are arranged to roll. As the coin moves down the ramp 6, it passes in succession three sensors, 10, 12 and 14. The outputs of the sensors are delivered to an interface circuit 16 to produce digital values which are read by a processor 18. Processor 18 determines whether the coin is valid, and if so the denomination of the coin. In response to this determination, an accept/reject gate 20 is either operated to allow the coin to be accepted, or left in its initial state so that the coin moves to a reject path 22. If accepted, the coin travels by an accept path 24 to a coin storage region 26. Various routing gates may be provided in the storage region 26 to allow different denominations of coins to be stored separately.

In the illustrated embodiment, each of the sensors comprises a pair of electromagnetic coils located one on each side of the coin path so that the coin travels therebetween. Each coil is driven by a self-oscillating circuit. As the coin passes the coil, both the frequency and the amplitude of the oscillator change. The physical structures and the frequency of operation of the sensors 10, 12 and 14 are so arranged that the sensor outputs are predominantly indicative of respective different properties of the coin (although the sensor outputs are to some extent influenced by other coin properties).

In the illustrated embodiment, the sensor 10 is operated at 60 KHz. The shift in the frequency of the sensor as the coin moves past is indicative of coin diameter, and the shift in amplitude is indicative of the material around the outer part of the coin (which may differ from the material at the inner part, or core, if the coin is a bicolour coin).

The sensor 12 is operated at 400 KHz. The shift in frequency as the coin moves past the sensor is indicative of coin thickness and the shift in amplitude is indicative of the material of the outer skin of the central core of the coin.

The sensor 14 is operated at 20 KHz. The shifts in the frequency and amplitude of the sensor output as the coin passes are indicative of the material down to a significant depth within the core of the coin.

Figure 2:
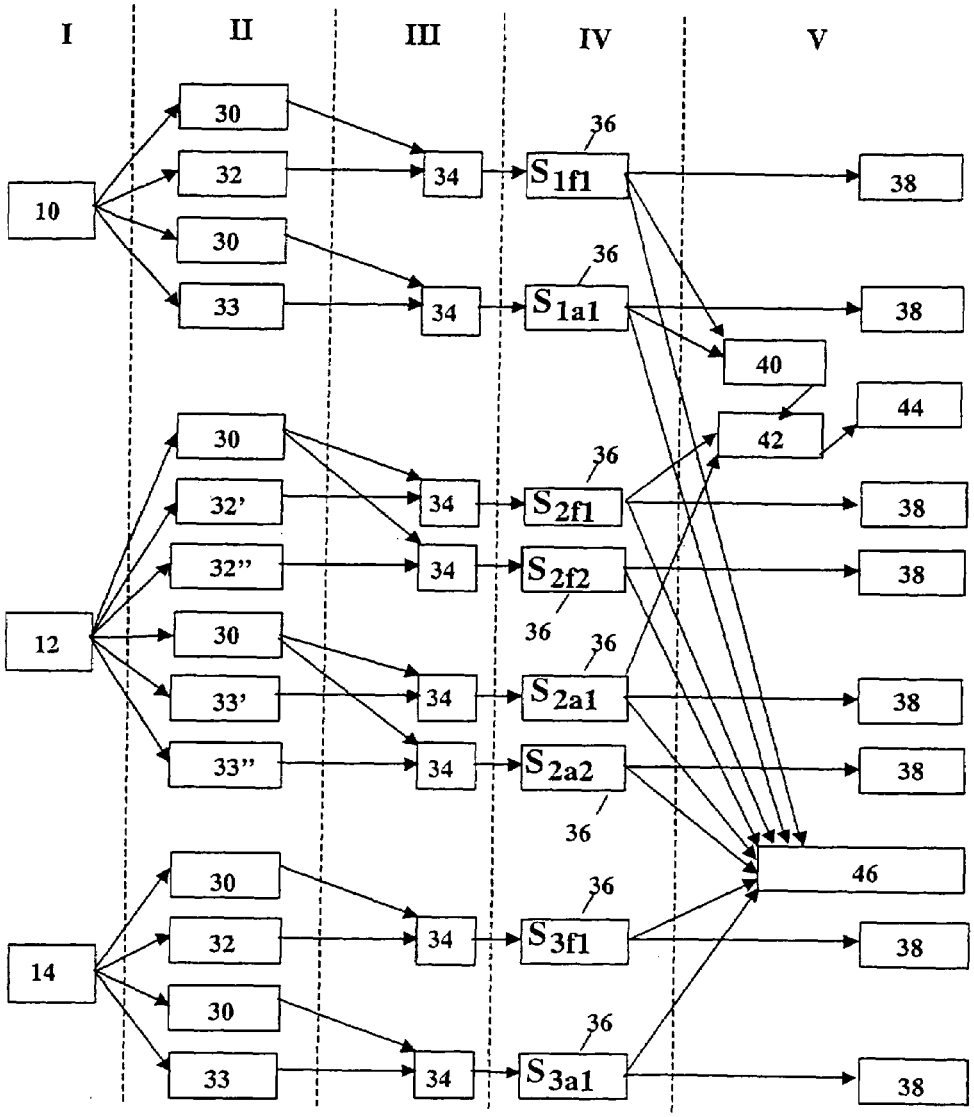
FIG. 2 is a diagram to illustrate the way in which sensor measurements are derived and processed.

FIG. 2 schematically illustrates the processing of the outputs of the sensors. The sensors 10, 12 and 14 are shown in section I of FIG. 2. The outputs are delivered to the interface circuit 16 which performs some preliminary processing of the outputs to derive digital values which are handled by the processor 18 as shown in sections II, III, IV and V of FIG. 2.

Within section II, the processor 18 stores the idle values of the frequency and the amplitude of each of the sensors, i.e. the values adopted by the sensors when there is no coin present. The procedure is indicated at blocks 30. The circuit also records the peak of the change in the frequency as indicated at 32, and the peak of the change in amplitude as indicated at 33. In the case of sensor 12, it is possible that both the frequency and the amplitude change, as the coin moves past, in a first direction to a first peak, and in a second direction to a negative peak (or trough) and again in the first direction, before returning to the idle value. Processor 18 is therefore arranged to record the value of the first frequency and amplitude peaks at 32' and 33' respectively, and the second (negative) frequency and amplitude peaks at 32" and 33" respectively.

At stage III, all the values recorded at stage II are applied to various algorithms at blocks 34. Each algorithm takes a peak value and the corresponding idle value to produce a normalised value, which is substantially independent of temperature variations. For example, the algorithm may be arranged to determine the ratio of the change in the parameter (amplitude or frequency) to the idle value. Additionally, or alternatively, at this stage III the processor 18 may be arranged to use calibration data which is derived during an initial calibration of the validator and which indicates the extent to which the sensor outputs of the validator depart from a predetermined or average validator. This calibration data can be used to compensate for validator-to-validator variations in the sensors.

At stage IV, the processor 18 stores the eight normalised sensor outputs as indicated at blocks 36. These are used by the processor 18 during the processing stage V which determines whether the measurements represent a genuine coin, and if so the denomination of that coin. The normalised outputs are represented as $S_{ijk}$ where:

i represents the sensor (1=sensor 10, 2=sensor 12 and 3=sensor 14), j represents the measured characteristic (f=frequency, a=amplitude) and k indicates which peak is represented (1=first peak, 2=second (negative) peak).

It is to be noted that although FIG. 2 sets out how the sensor outputs are obtained and processed, it does not indicate the sequence in which these operations are performed. In particular, it should be noted that some of the normalised sensor values obtained at stage IV will be derived before other normalised sensor values, and possibly even before the coin reaches some of the sensors. For example the normalised sensor values $S_{1f1}$, $S_{1a1}$ derived from the outputs of sensor 10 will be available before the normalised outputs $S_{2f1}$, $S_{2a1}$ derived from sensor 12, and possibly before the coin has reached sensor 12.

Referring to section V of FIG. 2, blocks 38 represent the comparison of the normalised sensor outputs with predetermined ranges associated with respective target denominations. This procedure of individually checking sensor outputs against respective ranges is conventional.

Block 40 indicates that the two normalised outputs of sensor 10, $S_{1f1}$ and $S_{1a1}$, are used to derive a value for each of the target denominations, each value indicating how close the sensor outputs are to the mean of a population of that target class. The value is derived by performing part of a Mahalanobis distance calculation.

In block 42, another two-parameter partial Mahalanobis calculation is performed, based on two of the normalised sensor outputs of the sensor 12, $S_{2f1}$, $S_{2a1}$ (representing the frequency and amplitude shift of the first peak in the sensor output).

At block 44, the normalised outputs used in the two partial Mahalanobis calculations performed in blocks 40 and 42 are combined with other data to determine how close the relationships between the outputs are to the expected mean of each target denomination. This further calculation takes into account expected correlations between each of the sensor outputs $S_{1f1}$, $S_{1a1}$ from sensor 10 with each of the two sensor outputs $S_{2f1}$, $S_{2a1}$ taken from sensor 12. This will be explained in further detail below.

At block 46, potentially all normalised sensor output values can be weighted and combined to give a single value which can be checked against respective thresholds for different target denominations. The weighting co-efficients, some of which may be zero, will be different for different target denominations.

The operation of the validator will now be described with reference to FIG. 3.

This procedure will employ an inverse co-variance matrix which represents the distribution of a population of coins of a target denomination, in terms of four parameters represented by the two measurements from the sensor 10 and the first two measurements from the sensor 12.

Thus, for each target denomination there is stored the data for forming an inverse co-variance matrix of the form:

| | | | | |
|---|---|---|---|---|
| M = | mat1,1 | mat1,2 | mat1,3 | mat1,4 |
| | mat2,1 | mat2,2 | mat2,3 | mat2,4 |
| | mat3,1 | mat3,2 | mat3,3 | mat3,4 |
| | mat4,1 | mat4,2 | mat4,3 | mat4,4 |

This is a symmetric matrix where mat x,y=mat y,x, etc. Accordingly, it is only necessary to store the following data:

| | | | |
|---|---|---|---|
| mat1,1 | mat1,2 | mat1,3 | mat1,4 |
| | mat2,2 | mat2,3 | mat2,4 |
| | | mat3,3 | mat3,4 |
| | | | mat4,4 |

For each target denomination there is also stored, for each property m to be measured, a mean value $x_m$.

The procedure illustrated in FIG. 3 starts at step 300, when a coin is determined to have arrived at the testing section. The program proceeds to step 302, whereupon it waits until the normalised sensor outputs $S_{1f1}$ and $S_{1a1}$ from the sensor 10 are available. Then, at step 304, a first set of calculations is performed. The operation at step 304 commences before any normalised sensor outputs are available from sensor 12.

At step 304, in order to calculate a first set of values, for each target class the following partial Mahalanobis calculation is performed:

$$D1=\text{mat}1,1\cdot\partial 1\cdot\partial 1+\text{mat}2,2\cdot\partial 2\cdot\partial 2+2\cdot(\text{mat}1,2\cdot\partial 1\cdot\partial 2)$$

where $\partial 1=S_{1f1}-x_1$ and $\partial 2=S_{1a1}-x_2$, and $x_1$ and $x_2$ are the stored means for the measurements $S_{1f1}$ and $S_{1a1}$ for that target class.

The resulting value is compared with a threshold for each target denomination. If the value exceeds the threshold, then at step 306 that target denomination is disregarded for the rest of the processing operations shown in FIG. 3.

It will be noted that this partial Mahalanobis distance calculation uses only the four terms in the top left section of the inverse co-variance matrix M.

Following step 306, the program checks at step 308 to determine whether there are any remaining target classes following elimination at step 306. If not, the coin is rejected at step 310.

Otherwise, the program proceeds to step 312, to wait for the first two normalised outputs $S_{2f1}$ and $S_{2a1}$ from the sensor 12 to be available.

Then, at step 314, the program performs, for each remaining target denomination, a second partial Mahalanobis distance calculation as follows:

$$D2=\text{mat}3,3\cdot\partial 3\cdot\partial 3+\text{mat}4,4\cdot\partial 4\cdot\partial 4+2\cdot(\text{mat}3,4\cdot\partial 3\cdot\partial 4)$$

where $\partial 3=S_{2f1}-x_3$ and $\partial 4=S_{2a1}-x_4$, and $x_3$ and $x_4$ are the stored means for the measurements $S_{2f1}$ and $S_{2a1}$ for that target class.

This calculation therefore uses the four parameters in the bottom right of the inverse co-variance matrix M.

Then, at step 316, the calculated values D2 are summed with the values D1 and the (D1+D2) values are compared with respective thresholds for each of the target denominations and if the threshold is exceeded that target denomination is eliminated. Instead of comparing (D1+D2) to the threshold, the program may compare just D2 with appropriate thresholds.

Assuming that there are still some remaining target denominations, as checked at step 318, the program proceeds to step 320. Here, the program performs a further calculation using the elements of the inverse co-variance matrix M which have not yet been used, i.e. the cross-terms at the bottom left and top right of the matrix M. The further calculation derives a value DX for each remaining target denomination as follows:

$$DX=2\cdot(\text{mat}1,3\cdot\partial 1\cdot\partial 3+\text{mat}1,4\cdot\partial 1\cdot\partial 4+\text{mat}2,3\cdot\partial 2\cdot\partial 3+\text{mat}2,4\cdot\partial 2\cdot\partial 4)$$

Then, at step 322, the program compares a value dependent on DX with respective thresholds for each remaining target denomination and eliminates that target denomination if the threshold is exceeded. The value used for comparison may be DX (in which case it could be positive or negative). Preferably however the value is D1+D2+DX. The latter sum represents a full four-parameter Mahalanobis distance taking into account all cross-correlations between the four parameters being measured.

At step 326 the program determines whether there are any remaining target denominations, and if so proceeds to step 328. Here, for each target denomination, the program calculates a value DP as follows:

$$DP=\sum_{n=1}^{8}\partial_n\cdot a_n$$

where $\partial_1 \ldots \partial_8$ represent the eight normalised measurements $S_{i,j,k}$ and $a_1 \ldots a_8$ are stored coefficients for the target denomination. The values DP are then at step 330 compared with respective ranges for each remaining target class and any remaining target classes are eliminated depending upon whether or not the value falls within the respective range. At step 334, it is determined whether there is only one remaining target denomination. If so, the coin is accepted at step 336. The accept gate is opened and various routing gates are controlled in order to direct the coin to an appropriate destination. Otherwise, the program proceeds to step 310 to reject the coin. The step 310 is also reached if all target denominations are found to have been eliminated at step 308, 318 or 326.

The procedure explained above does not take into account the comparison of the individual normalised measurements with respective window ranges at blocks 38 in FIG. 2. The procedure shown in FIG. 3 can be modified to include these steps at any appropriate time, in order to eliminate further the number of target denominations considered in the succeeding stages. There could be several such stages at different points within the program illustrated in FIG. 3, each for checking different measurements. Alternatively, the individual comparisons could be used as a final boundary check to make sure that the measurements of a coin about to be accepted fall within expected ranges. As a further alternative, these individual comparisons could be omitted.

In a modified embodiment, at step 314 the program selectively uses either the measurements $S_{2f1}$ and $S_{2a1}$ (representing the first peak from the second sensor) or the measurements $S_{2f2}$ and $S_{2a2}$ (representing the second peak from the second sensor), depending upon the target class.

It will be appreciated that each n-parameter Mahalanobis distance calculation (where n is the number of measurements) is split into several stages, each involving a subset of the measurements (i.e. less than n). This means that the sub-calculation performed at that stage uses data which is different from the data which would be used if it were derived from correlations between only the subset of measurements. Accordingly, the result (e.g. D1, D2 or D4) of each individual stage is not a true Mahalanobis distance. Nevertheless, it is a useful discriminator.

It is to be noted that this procedure differs from known hierarchical classifiers. There is also a further difference, in that, in known hierarchial classifiers, the type of test performed at each stage will depend on the remaining target classes. In the present embodiment, however, the same type of test (i.e. the same predetermined subset of properties) is examined at each of steps 304, 314 and 320, irrespective of the remaining target classes.

There are a number of advantages to performing the Mahalanobis distance calculations in the manner set out above. It will be noted that the number of calculations performed at stages 304, 314 and 320 progressively decreases as the number of target denominations is reduced. Therefore, the overall number of calculations performed as compared with a system in which a full four-parameter Mahalanobis distance calculation is carried out for all target denominations is substantially reduced, without affecting discrimination performance. Furthermore, the first calculation at step 304 can be commenced before all the relevant measurements have been made.

The sequence can however be varied in different ways. For example, steps 314 and 320 could be interchanged, so that the cross-terms are considered before the partial Mahalanobis distance calculations for measurements $\partial 3$ ($=S_{2f1}-x_3$) and $\partial 4$ ($=S_{2a1}-x_4$) are performed. However, the sequence described with reference to FIG. 3 is preferred because the calculated values for measurements $\partial 3$ and $\partial 4$ are likely to eliminate more target classes than the cross-terms.

In the arrangement described above, all the target classes relate to articles which the validator is intended to accept. It would be possible additionally to have target classes which relate to known types of counterfeit articles. In this case, the procedure described above would be modified such that, at step 334, the processor 18 would determine (a) whether there is only one remaining target class, and if so (b) whether this target class relates to an acceptable denomination. The program would proceed to step 336 to accept the coin only if both of these tests are passed; otherwise, the coin will be rejected at step 310.

Other distance calculations can be used instead of Mahalanobis distance calculations, such as Euclidean distance calculations.

The acceptance data, including for example the means $x_m$ and the elements of the matrix M, can be derived in a number of ways. For example, each mechanism could be calibrated by feeding a population of each of the target classes into the apparatus and reading the measurements from the sensors, in order to derive the acceptance data. Preferably, however, the data is derived using a separate calibration apparatus of very similar construction, or a number of such apparatuses in which case the measurements from each apparatus can be processed statistically to derive a nominal average mechanism. Analysis of the data will then produce the appropriate acceptance data for storing in production validators. If, due to manufacturing tolerances, the mechanisms behave differently, then the data for each mechanism could be modified in a calibration operation. Alternatively, the sensor outputs could be adjusted by a calibration operation.

The invention claimed is:

1. A method of determining whether or not an article of currency belongs to any one of a plurality of target classes, the method comprising:

(i) deriving a plurality of measurements of the article; and (ii) using the measurements in a plurality of correlation calculations, each of said correlation calculations being associated with a respective one of said plurality of target classes, to determine the extent to which a relationship between the measurements conforms to a correlation between the measurements in a population of a respective one of said target classes, and hence whether or not said article of currency belongs to said respective target class, wherein each of said plurality of correlation calculations is an n-parameter Mahalanobis distance calculation;

wherein, for each of said plurality of correlation calculations and respective target classes:

(iii) said correlation calculation comprises a plurality of successive classification stages, each successive classification stage performing a part only of said n-parameter Mahalanobis distance calculation, at least one of said successive classification stages using a subset of n said measurements corresponding to said n parameters, and the successive classification stages being such that the sum of successive partial correlation calculations is either equal to the full n-parameter Mahalanobis distance calculation or a part of the n-parameter Mahalanobis distance calculation; and (iv) at least one said successive classification stage is used to determine whether the article does not belong to said respective target class.

2. The method as claimed in claim 1 wherein at least one measurement used during a classification stage is a measurement which was not available at the commencement of an earlier classification stage.

3. The method as claimed in claim 1 wherein at least one classification stage uses a combination of values calculated during both that stage and a previous stage.

4. The method as claimed in claim 1 wherein each of said plurality of correlation calculations corresponds to calculation of a Mahalanobis distance.

5. The method as claimed in claim 4 wherein at least two classification stages perform respective parts of a Mahalanobis distance calculation for respective sets of measurements, and a further classification stage completes the Mahalanobis distance classification.

6. The method as claimed in claim 5 wherein the further classification stage involves the step of summing the results of said at least two classification stages with a further value in order to derive a Mahalanobis distance.

7. The method as claimed in claim 1 to validate coins.

8. The method as claimed in claim 1 to validate banknotes.

9. The method as claimed in claim 1 comprising, for at least one said correlation calculation, summing two or more successive partial correlation calculations.

10. The method as claimed in claim 1 comprising, for at least one said correlation calculation, summing all successive partial correlation calculations.

11. The method of claim 1 wherein at least one said successive classification stage is a partial Mahalanobis distance calculation involving p of said n parameters, where p is less than n and greater than or equal to 2.

12. The method of claim 11 wherein the n-parameter Mahalanobis distance calculation involves an inverse covariance matrix, and at least one said successive classification stage uses the coefficients in a pxp square with the p diagonal coefficients on the diagonal of said inverse covariance matrix.

* * * * *